United States Patent [19]

Bottega

[11] Patent Number: 4,811,846

[45] Date of Patent: Mar. 14, 1989

[54] PIZZA POUCH

[76] Inventor: Philip M. Bottega, 28 Frandsen Ave., South River, N.J. 08882

[21] Appl. No.: 169,023

[22] Filed: Mar. 16, 1988

[51] Int. Cl.[4] ..... B65D 81/00; B65D 81/36

[52] U.S. Cl. ..... 206/542; 206/551; 229/125.03; 426/124

[58] Field of Search ..... 206/541, 542, 545, 548, 206/550, 551, 553, 557, 459; 229/2.5 R, 103, 107, 125.03; 426/124

[56] References Cited

U.S. PATENT DOCUMENTS

| | | | |
|---|---|---|---|
| 1,607,865 | 11/1926 | Butler | 206/542 |
| 1,625,335 | 4/1927 | Schneider | 229/125.03 |
| 2,525,337 | 10/1950 | Brooks et al. | 206/551 |
| 2,584,379 | 2/1952 | Chmielewski | 206/551 |
| 2,771,188 | 11/1956 | Coulter | 206/553 |
| 3,620,411 | 11/1971 | Rump | 206/551 |
| 3,968,921 | 7/1976 | Jewell | 229/2.5 R |
| 4,193,496 | 3/1980 | Barratt | 229/2.5 R |
| 4,241,863 | 12/1980 | Faller | 229/2.5 R |
| 4,373,636 | 2/1983 | Hoffman | 206/551 |
| 4,465,190 | 8/1984 | Cillario | 229/2.5 R |

*Primary Examiner*—Jimmy G. Foster

*Attorney, Agent, or Firm*—Richard L. Miller

[57] ABSTRACT

This pizza pouch is designed for take-out slices of pizza pie, without the slices having to be placed in a plate, on wax paper and then being placed in a bag. Primarily, it consists of a foam/plastic body having its tray portion hinged to a cover, and a foil panel is provided on the interior for serving as a separator wall between two slices of pizza. A groove of special design is also provided in the tray portion for firmly holding and retaining the edges of the foil panel.

1 Claim, 1 Drawing Sheet

FIG. 1
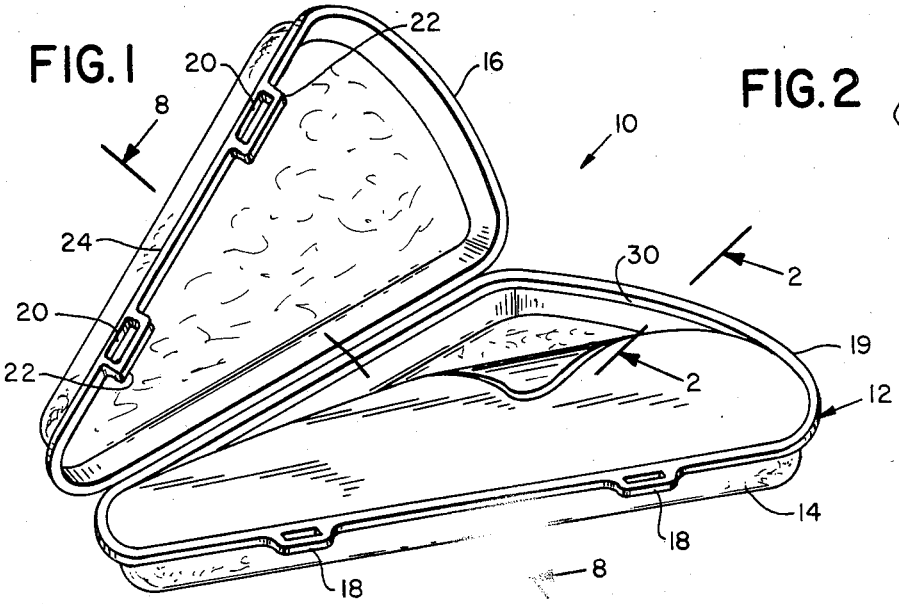
FIG. 2
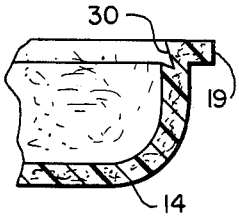
FIG. 3
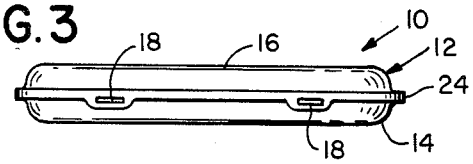
FIG. 4
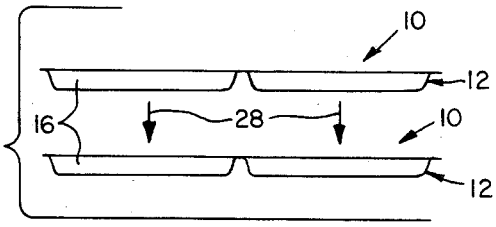
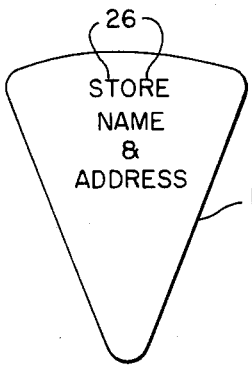
FIG. 5
FIG. 7
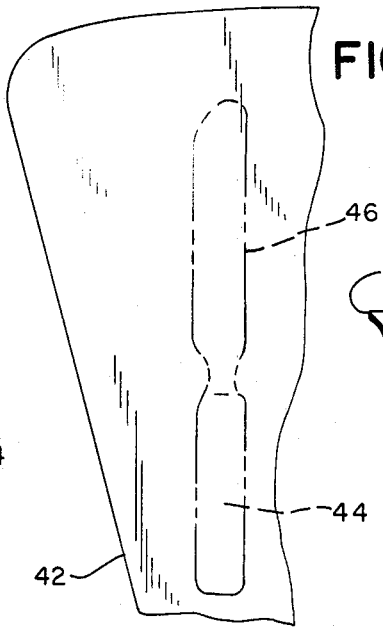
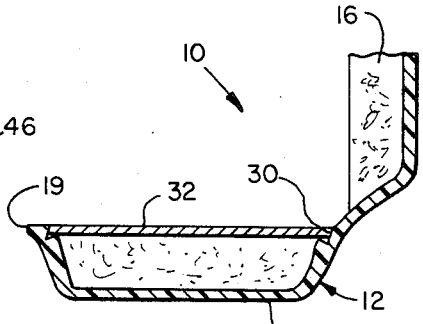
FIG. 8
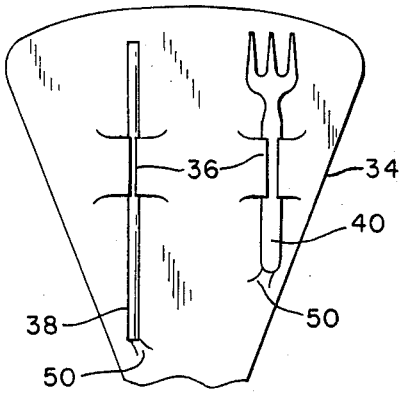
FIG. 6

PIZZA POUCH

BACKGROUND OF THE INVENTION

The instant invention relates generally to containers, and more particularly, to a pizza pouch.

Numerous containers have been provided in the prior art that are adapted to hold food for transport. For example, U.S. Pat. Nos. 4,373,636 of Hoffman, 3,620,411 of Rump, and 3,620,403 of Rump, all are illustrative of such prior art. While these units may be suitable for the particular purpose to which they address, they would not be as suitable for the purpose of the present invention as hereafter described.

SUMMARY OF THE INVENTION

A primary object of the present invention is to provide a pizza pouch that will overcome the shortcomings of the prior art devices.

Another object is to provide a pizza pouch that will effectively retain a slice or two of pizza pie for transport from a store without leakage of its contents.

An additional object is to provide a pizza pouch that will enable the eating of a slice without requiring two hands and a roll of paper towels for clean up afterwards.

Ordinarily, when a person orders a slice of pizza to take out, the seller folds up the very hot and oily slice of pizza, places it on a paper plate covered with wax paper, inserts it in a brown paper bag and hands it to them. By the time they reach the exit door of the establishment the bag is leaking oil and sauce at the bottom. The slaughtered slice is very hard to eat while sitting on a park bench or even when taken back to the buyer's office.

The present invention is so designed, as to be of one-piece construction and will keep the slice or pair of slices hot, and will not require being brown bagged, as well. Further, the design will be a great advantage to vendors, as the product will stack and store easily, and will virtually eliminate the former need for a plate, wax paper, etc. Even further, the vendor's name, address, and other data may be custom printed thereon, thus serving as a trendy marking device.

A further object is to provide a pizza pouch that is simple and easy to use.

A still further object is to provide a pizza pouch that is economical in cost to manufacture.

Further objects of the invention will appear as the description proceeds.

To the accomplishment of the above and related objects, this invention may be embodied in the form illustrate in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a perspective view of the instant invention, shown in open condition and illustrating a foil spacer for separating slices partially removed therefrom;

FIG. 2 is an enlarged fragmentary cross sectional view taken along line 2—2 of FIG. 1;

FIG. 3 is a side elevational view of the invention, shown in closed condition;

FIG. 4 is a diagrammatic end view of the instant invention showing the method of stacking a plurality of the articles one within another;

FIG. 5 is a diagrammatic top plan view of the top cover of the instant invention;

FIG. 6 is a fragmentary diagrammatic top plan view, showing a first modification that includes a straw and fork;

FIG. 7 is similar to FIG. 6, but shows a second modified form that included a push-out knife; and FIG. 8 is a cross sectional view taken along line 8—8 of FIG. 1.

DETAILED DESCRIPTION OF THE PREFERRED EMBODIMENTS

Turning now descriptively to the drawings, in which like reference characters denote like elements throughout the several views, a pouch 10 is shown to include a triangular foam/plastic body 12, consisting of a base tray 14 and a hinged cover 16, the hinge being an integrally attached area along one longitudinal side of both the base tray 14 and the cover 16. A pair of tongues 18 are spaced from each other and integrally attached to an outwardly extending flange 19 formed on the upper portion of base tray 14, and are removably received in an opening 20 provided through a pair of similarly spaced projections 22 integrally attached to a similar flange 24 provided on cover 16 as is well known in the art. The above arrangement provides for firmly holding the cover 16 closed on the base tray 14 after filling pouch 10.

Imprinted on top of cover 16 are characters 26 indicating the name and address of a store, for advertising purposes, and attention will be directed to FIG. 4 where the stacking of a plurality of pouches 10 is demonstrated by the arrows 28.

An angular and downwardly disposed inner peripheral groove 30 is provided in the upper portion of base tray 14 and frictionally engages with and receives the outer peripheral edge of a panel 32 of foil that acts as an inner separator wall, for complete separation of a bottom placed slice of pizza and a top positioned slice of pizza (not shown) if desired.

In use, one slice of pizza is placed in base tray 14 and foil panel 32 is tucked into the groove 30 where it remains until lifted to remove the slice of pizza. When desired, a second slice of pizza is placed on top of the panel 32 and the cover is pivoted closed with the tongues 18 of base tray 14 being entered into the openings 20 of projections 22 of cover 16.

Referring now to FIG. 6, a first modified cover 34 is provided with cut-out clips 36 that retain both a straw 38 and a fork 40.

In use, the straw 38 and the fork 40 are pulled away from the clips 36 for use, and depending upon the material used for fabrication of the instant invention the the straw 38 and fork 40 may be integrally molded and attached by tabs 50 all in one operation along with the molding of the base tray 14.

Looking now at FIG. 7, a second modified form of cover 42 is provided with a knife 44, defined by the perforations 46.

In use, knife 44 is removed from cover 42 by breaking it out along the perforations 46.

It shall be noted that a spoon (not shown) may be substituted for by the fork 44.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pizza pouch, comprising, a base tray, a cover hinged to said base tray, and flexible panel means provided in said base tray, providing separation for two slices of pizza pie, wherein a first slice of pizza is placed in a bottom portion of said base tray and peripheral side edges of said panel means are engaged within an outwardly angled and downwardly angled groove provided below an upper rim portion of said base tray, and said panel means is frictionally engaged in the groove and separates a second slice of pizza placed on top of said panel means, and said cover pivots shut over said second slice of pizza on top of said panel means, with a plurality of cut-out clips through material of said cover, and said clips are spaced apart and engage over and retain a fork and straw removably.

* * * * *